US010293991B2

(12) United States Patent
Schindler

(10) Patent No.: US 10,293,991 B2
(45) Date of Patent: May 21, 2019

(54) TWO CHANNELED BOTTLE POURER

(71) Applicant: BETTER TMRW LLC, St. Louis, MO (US)

(72) Inventor: Daniel Schindler, St. Louis, MO (US)

(73) Assignee: BETTER TMRW LLC, St. Louis, MO (US)

( * ) Notice: Subject to any disclaimer, the term of this patent is extended or adjusted under 35 U.S.C. 154(b) by 0 days.

(21) Appl. No.: 15/933,963

(22) Filed: Mar. 23, 2018

(65) Prior Publication Data

US 2018/0297754 A1 Oct. 18, 2018

Related U.S. Application Data

(60) Provisional application No. 62/485,901, filed on Apr. 15, 2017.

(51) Int. Cl.
*B65D 47/08* (2006.01)
*B65D 47/32* (2006.01)
*B65D 51/28* (2006.01)

(52) U.S. Cl.
CPC ..... *B65D 47/32* (2013.01); *B65D 47/0885* (2013.01); *B65D 51/2807* (2013.01)

(58) Field of Classification Search
CPC ..... B65D 47/32; B65D 51/2807
USPC ..... 222/478
See application file for complete search history.

(56) References Cited

U.S. PATENT DOCUMENTS

| | | | | |
|---|---|---|---|---|
| 2,980,302 | A | 4/1961 | Rasmussen | |
| 7,055,685 | B1 | 6/2006 | Patterson et al. | |
| 8,245,882 | B1 * | 8/2012 | Federighi | B01F 3/04503 222/190 |
| 8,328,010 | B2 | 12/2012 | Lee et al. | |
| 9,624,021 | B2 * | 4/2017 | Bodet | B65D 81/325 |
| 2003/0072850 | A1 | 4/2003 | Burniski | |
| 2007/0205218 | A1 * | 9/2007 | Mueller | B05B 11/0081 222/129 |
| 2015/0336722 | A1 * | 11/2015 | Brook-Chrispin | B65D 51/28 215/228 |
| 2016/0280449 | A1 * | 9/2016 | Mekata | B65D 81/325 |

FOREIGN PATENT DOCUMENTS

WO 2011149501 A1 12/2011

* cited by examiner

*Primary Examiner* — Jeremy Carroll
(74) *Attorney, Agent, or Firm* — Husch Blackwell LLP

(57) ABSTRACT

A pourer attachment that is selectively engageable with a bottle is provided for pouring and mixing a base liquid (e.g., liquor) and a secondary liquid (e.g., hydration concentration). The pourer includes a neck section and a base section. The base section includes a reservoir for containing the secondary liquid and is in fluid communication with a secondary liquid channel of the neck section through which the secondary liquid may be poured when a lid associated with the pourer is open. An aperture in the lid allows the base liquid to be poured when the lid is in a closed position. As such, when the lid is in its open position, both the secondary liquid and base liquid may be poured and mixed, and when the lid is in its closed position, only the base liquid may be poured.

20 Claims, 4 Drawing Sheets

TWO CHANNELED BOTTLE POURER

CROSS-REFERENCE TO RELATED APPLICATIONS

This application claims the benefit of U.S. Provisional Application No. 62/485,901, filed Apr. 15, 2017, which is hereby incorporated by reference in its entirety.

FIELD OF THE INVENTION

The present disclosure relates to a pourer, more particularly to a pourer that may be inserted into the neck of a bottle. The pourer contains a secondary liquid which may be mixed with a base liquid, contained within the bottle, as the base liquid is being poured from the bottle.

BACKGROUND OF THE INVENTION

Alcohol is a $475 billion dollar industry in the United States alone. People consume alcohol both for its taste and socially. But, there are some people that dislike the taste of alcohol and would prefer something mixed with the alcohol to disguise the taste. Those people like to add secondary liquids, such as liquid concentrates, soda, fruit juices, caffeinated beverages, carbonated water, tonic water, syrups, or sauces, as a mixer, to their alcohol. However, adding secondary liquids is time consuming, thereby creating long lines and extended wait times because the bartender needs to open new bottles and containers for each secondary liquid. Sometimes, multiple secondary liquids are required for a single drink. Moreover, the bartender may also need to adjust and push various button and/or switches for each secondary liquid, which further causes long lines and extended wait times, and also reduces the amount of income generated. While pre-mixed drinks would reduce the long lines and extended wait times, they are illegal in many states. In such states, alcohol may not be mixed with secondary liquids before a customer orders the drink. Drinks may only be mixed, outside of a bottle, for immediate consumption—thus, only on the premise and only after the drink has been ordered.

There are also other people who overindulge with alcohol, resulting in a hangover the next day. Hangovers can cause fatigue and weakness, excessive thirst and dry mouth, headaches and muscle aches, nausea, vomiting or stomach pain, increased sensitivity to light and sound, dizziness, shakiness, inability to concentrate, adverse mood changes, and a rapid heartbeat. Due to the physical discomfort caused by a hangover, a hangover can prevent a person from accomplishing anything the following day. In order to combat the effects of the hangover, people may take painkillers, consume sports drinks or greasy food, or drink the "hair of the dog." However, none of these methods can entirely eliminate hangover symptoms.

People also try to prevent hangovers by drinking water in between drinks, consuming sport drinks or water before bed, or preemptively taking painkillers. However, with all three of those methods, people have to remember to take deliberate, specific actions while drinking or before bed. People inevitably forget or do not drink enough hydrating liquids, and therefore fail to prevent a hangover. One method of ensuring a person drinks enough hydrating liquids is by having the bartender add a hydration concentrate to the alcoholic drink. However, measuring, pouring, and mixing a hydration concentrate with the alcohol is difficult and time consuming. Adding a hydrating concentrate to an alcoholic drink creates the same problems as making a mixed drink—it is slow, creates long lines, and extended wait times.

Therefore, it would be desirable to provide an innovative delivery system that allows a mixer, a hydrating, and/or a favored secondary liquid, or liquid concentrate, to mix with the alcohol as it is being poured into a glass.

SUMMARY OF THE INVENTION

A two channeled bottle pourer is provided that allows a user to dispense and combine a secondary liquid (e.g., a liquid flavor concentrate), and a base liquid (e.g., liquor) outside the bottle, while pouring. The pourer may also allow a user to combine the secondary liquid and base liquid in a pre-determined ratio without requiring the user to measure either the secondary liquid or base liquid before combining the liquids. The pourer attachment further preferably allows the user to choose whether to dispense both the secondary liquid and the base liquid or just the base liquid without removing the pourer from the bottle.

More particularly, when a neck section of the pourer is engaged with a base section of the pourer, a secondary liquid channel is in fluid communication with the secondary liquid, which is contained within a reservoir. Therefore, the secondary liquid may be dispensed from the reservoir when a user utilizes the pourer. Similarly, when the neck section is engaged with the base section, a base liquid channel is in fluid communication with the base liquid within the bottle and may be dispensed from the bottle.

The user of the pourer attachment may decide whether to dispense both the secondary liquid and base liquid at the same time or only dispense the base liquid, without removing the pourer attachment. When the user wants to dispense both the secondary liquid and the base liquid, the user places a lid of the pourer in an open position, or a first position, thereby allowing the secondary liquid and base liquid to be dispensed and to be combined outside of the bottle while pouring. If the user only wants to dispense the base liquid, then the user places the lid in a closed position, or a second portion, which allows a plug of the lid to engage the secondary liquid channel and prevent the secondary liquid from being dispensed while the base liquid is being poured through a lid aperture. Thus, the pourer attachment allows a user to dispense either both the base liquid and the secondary liquid or just the base liquid by placing the lid in an open position or a closed position, respectively.

Various other aspects, objects, features and embodiments of the present disclosure are disclosed with reference to the following specification, including the drawings.

Notwithstanding the above examples, the present disclosure is intended to encompass a variety of other embodiments including for example other embodiments as are described in further detail below as well as other embodiments that are within the scope of the claims set forth herein.

BRIEF DESCRIPTION OF THE DRAWINGS

For a better understanding of the various embodiments of the present invention, reference may be made to the accompanying drawings in which.

Figure 1:
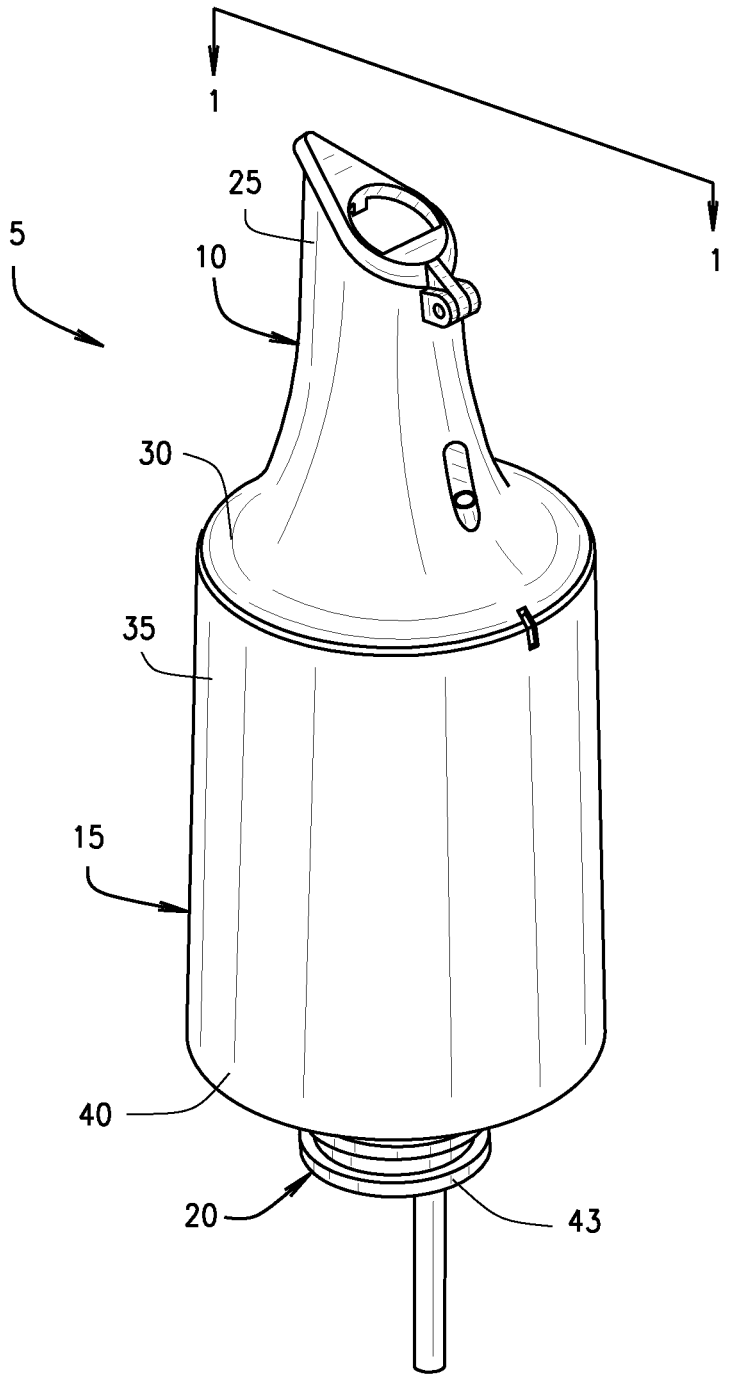
FIG. 1 is a perspective view of a pourer constructed in accordance with the embodiments of the present disclosure.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure.

DETAILED DESCRIPTION OF THE DRAWINGS

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Turning to FIG. 1, a pourer 5 is provided. The pourer 5, in many ways, is like many of those that are used in the alcohol industry to dispense a base liquid from a bottle. Non-inclusive examples of a base liquid may be rum, whiskey, vodka, sherry, tequila, gin, absinthe, ouzo, and other liqueurs. The pourer 5 enables a person to choose whether to dispense both a secondary liquid and a base liquid or only the base liquid without requiring a person to remove the pourer attachment. Non-inclusive examples of the secondary liquid may be flavor concentrates, hydration concentrates, soda, fruit juices, caffeinated beverages, carbonated water, tonic water, syrups, or sauces. The secondary liquid and the base liquid may be dispensed in a predetermined ratio, without requiring either liquid to be measured. The pourer 5 may be made out of a variety of rigid or semi-rigid materials, but in the preferred embodiment, is made of a plastic material. When not in use, the pourer 5 may be stored, for example, in a drawer or a box, or left engaged on a bottle.

After the pourer 5 is mated with the bottle (as described below), a base liquid channel in the pourer 5 allows the base liquid within the bottle to be dispensed through the pourer 5. When a lid of a neck section 10 of the pourer 5 is in the open position, the secondary liquid may be dispensed from a reservoir within a base section 15 of the pourer 5 through a secondary liquid channel. When both the secondary liquid and the base liquid are dispensed, both liquids are preferably mixed outside of the pourer 5 and bottle. The streams of both of the secondary liquid and the base liquid preferably mix in the air, while pouring, to create a single stream of both the secondary and base liquids. Due to the sizes of the base liquid channel and the secondary liquid channel relative to each other, the secondary liquid and base liquid are dispensed in a pre-determined ratio.

The pourer 5 preferably includes a neck section 10, base section 15, and a rubber stopper 20 which are formed separately from one another and releasably attached with one another, as will be described below. In one embodiment, the neck section 10 is preferably shaped as a tapered tube, wherein an upper neck end 25 of the neck section 10 has a smaller cross-sectioned area than a lower neck end 30 of the neck section 10. However, in alternative embodiments, the neck section 10 may be different shapes, and the upper neck end 25 may have the same cross-sectioned area as the lower neck end 30, or the upper neck end 25 may have a larger cross-sectioned area than the lower neck end 30.

The base section 15 is preferably cylinder shaped, and the diameter of the base section 15 may be sized so that the lower neck end 30 of the neck section 10 is releasably engageable with the base section 15. In alternative embodiments, the base section 15 may take on many different shapes and forms, as long as an upper base end 35 is able to releasably engage with the lower neck end 30. The manner in which neck section 10 may be releasably engaged with the base section 15 may take on many forms, but in one embodiment, the neck section 10 is releasably engaged with the base section 15 through a twist fastener. Moreover, the seal formed between the neck section 10 and the base section 15 is preferably leak-proof so that when the pourer 5 is used, the secondary liquid will not spill. The tightness of the seal may be improved by known techniques, for example, by the use of O-rings, gaskets, and the like. In the embodiment illustrated in FIG. 1, the neck section 10 is a tapered tube, with the lower neck end 30 being circular and slightly smaller in diameter than the cylindrical base section 15, and is therefore able to releasably engage with the base section 15.

The rubber stopper 20 of the pourer 5 is adjacent to a lower base end 40, and is designed to fit into and mate with the neck of a bottle, such as a liquor bottle. The rubber stopper 20 may be inserted through the opening of the bottle and into its neck to allow the pourer 5 to selectively engage the bottle. The manner in which the rubber stopper 20 may be releasably engaged with the bottle may take on several different forms. In one embodiment, the rubber stopper 20 is releasably engaged with the bottle through a friction fit. The seal formed between the rubber stopper 20 and the bottle is preferably leak-proof so that the base liquid does not spill when the pourer 5 is being used. The rubber stopper 20 may be shaped so that the sides of the rubber stopper 20 include a series of flexible protrusions 43 in order to improve the fit and seal between the bottle and rubber stopper 20. In other embodiments, the sides of the rubber stopper 20 may be smooth.

As will be described in more detail hereinafter, when the pourer 5 is engaged with the bottle, the base liquid may be dispensed from the bottle. In addition to the base liquid, the secondary liquid may also be dispensed when the lid on the upper neck end 25 has been raised. Alternatively, when the lid on the upper neck end 25 has been lowered, the base liquid may still be dispensed, even if the secondary liquid is not.

Figure 2:
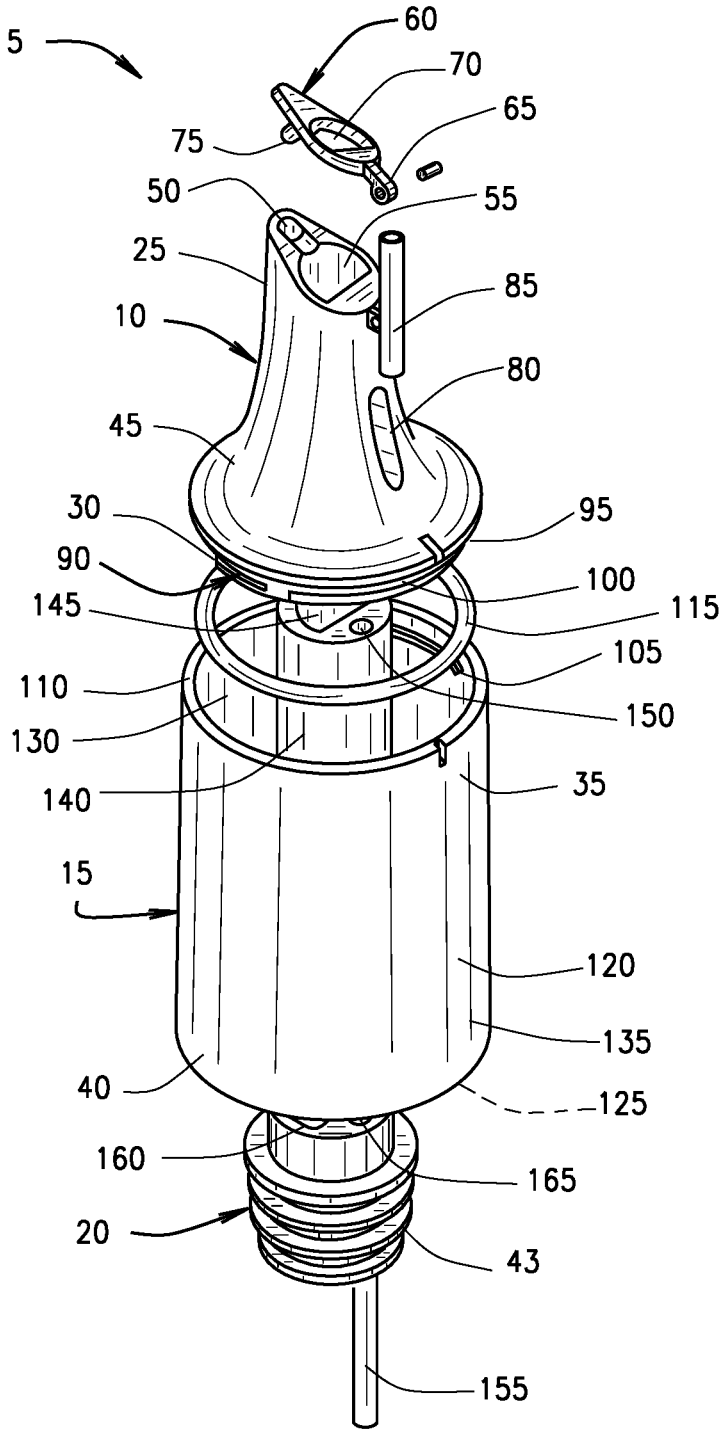
FIG. 2 is an exploded perspective view of the pourer of FIG. 1.

As described above previously, the neck section 10 of the pourer 5 includes a tapered tube 45, which extends from the upper neck end 25 to the lower neck end 30. Turning to FIG. 2, the tapered tube 45 includes a secondary liquid channel 50 and a base liquid upper channel 55 which both extend throughout the entire interior of the tapered tube 45, from the upper neck end 25 to the lower neck end 30 of the neck section 10, with only upper ends of the channels are shown in FIG. 2. The channels are shown in their entirety in FIG. 3, described below. The secondary liquid channel 50 dispenses the secondary liquid from a reservoir (which will be described in more detail hereinafter). The base liquid upper channel 55, on the other hand, dispenses the base liquid from the bottle (not shown) and will also be described in more detail hereinafter.

The neck section 10 of the pourer 5 further includes a lid 60. The lid 60 may be shaped to be substantially planar and have substantially the same area as the upper neck end 25 of the neck section 10. However, in alternative embodiments, the lid 60 may have a different shape and/or have either a larger or smaller area than the area of the upper neck end 25 of the neck section 10, as long as the lid 60 is still able to prevent the secondary liquid from being dispensed. The lid 60 is preferably attached to the upper neck end 25 of the neck section 10 by a pivot hinge 65 and is therefore able to selectively engage the upper neck end 25 of the tapered tube 45, although other methods of attaching the lid 60 to the neck section 10 are known in the art and are envisioned and foreseeable.

The lid 60 may further include each of a lid aperture 70 and a plug 75. The lid aperture 70 is preferably shaped and sized so that lid aperture 70 has substantially the same diameter as the diameter of the base liquid upper channel 55 and aligns with the channel 55 when the lid 60 is closed. In other embodiments, lid aperture 70 may be different shapes and sizes. The plug 75 may be shaped to fit and mate with the secondary liquid channel 50 of the tapered tube 45. The plug 75 may be made out of rubber, although other materials are envisioned and foreseeable. The releasably engageable plug 75 preferably creates a liquid tight seal with the secondary liquid channel 50 through a friction fit, although other methods are contemplated. Thus, when the lid 60 is closed and engages the upper neck end 25 of the tapered tube 45, the plug 75 also engages the secondary liquid channel 50 of the tapered tube 45, thereby preventing the secondary liquid from being dispensed if the pourer 5 is tilted.

When the lid 60 is closed so that it engages the upper neck end 25 of the tapered tube 45, the lid aperture 70 is positioned and located over the base liquid upper channel 55 of the tapered tube 45. The base liquid may therefore still be dispensed even when the lid 60 engages with the upper neck end 25 of the tapered tube 45. Thus, when the lid 60 engages the upper neck end 25 of the tapered tube 45, only the base liquid may be dispensed.

The neck section 10 of the pourer 5 also may include a secondary liquid straw aperture 80 with a secondary liquid straw 85 that may be placed within the aperture 80. The secondary liquid straw aperture 80 is preferably a channel extending from the lower neck end 30, through the interior of the tapered 45, and emerges from the side of the tapered tube 45 of the neck section 10. The secondary liquid straw 85 connects the reservoir to the ambient environment, acting as a vent for improving pouring (which will be explained in more detail hereinafter).

The neck section 10 may include an annular ring 90 that projects downwardly and away from a lower surface 95 of the tapered tube 45. The ring 90 preferably has a smaller diameter than the lower neck end 30 of the tapered tube 45. The annular ring 90 includes a first set of threads 100, which extend radially outwardly from an outer surface of the annular ring 90. Similarly, the base section 15 may have a second set of threads 105, which extend radially inwardly from an inner surface of the base section 15. The first set of threads 100 and the second set of threads 105 allow the neck section 10 and base section 15 to selectively engage each other through a threaded engagement as known and understood in the art. When the neck section 10 and base section 15 are ready to be engaged, the neck section 10 is positioned over the base section 15 so that the annular ring 90 is inserted into the base section 15 and the lower surface 95 of the neck section 10 rests on and abuts an upper rim 110 of the base section 15. The neck section 10 and the base section 15 may then engage through a threaded engagement with the neck section 10 being turned clockwise to engage the neck section 10 to the base section 15. Likewise, the neck section 10 may be turned counterclockwise to disengage the neck section 10 with the base section 15. Other methods of engaging the neck section 10 with the base section 15 are envisioned and foreseeable.

In other embodiments, an O-ring 115 may be located and positioned so that the annular ring 90 extends through the O-ring 115. In that embodiment, the O-ring abuts both the lower surface 95 of the neck section 10 and the upper rim 110 of the base section 15 when the neck section 10 and base section 15 are engaged to help prevent any liquid from leaking from the pourer 5.

Figure 3:
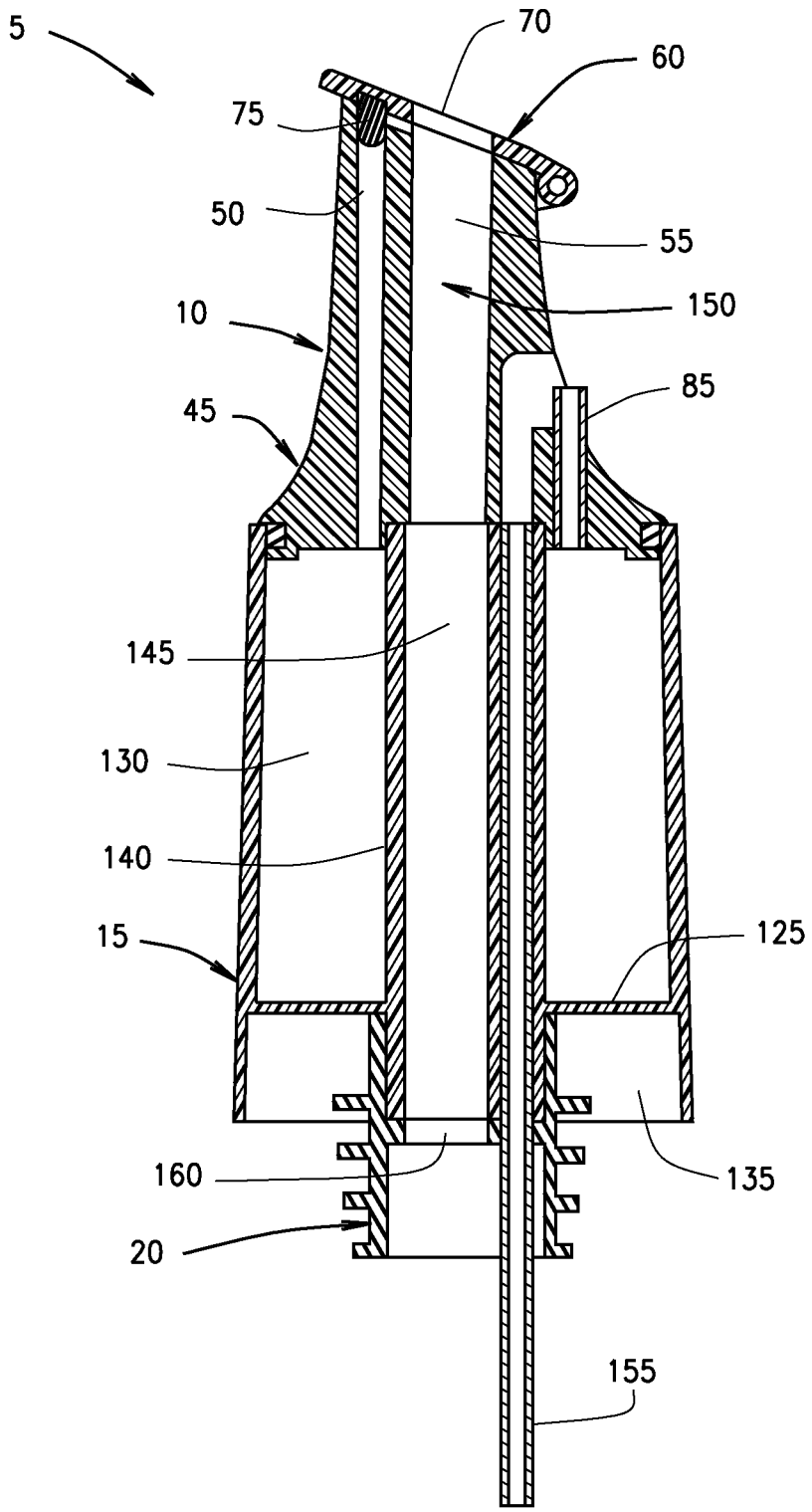
FIG. 3 is a cross sectional view of the pourer of FIGS. 1-2 taken along line 1-1.

As shown in FIGS. 2 and 3, the base section 15 preferably includes a main body 120, which is preferably formed as a cylinder including a lower bottom end 125 and upper base end 35, thereby creating a liquid containing reservoir 130. The reservoir 130 may be used to contain the secondary liquid therein. An upper rim 110 circumscribes the base section 15. However, as will be understood, the main body 120 may take any other form as would be known in the art. Similarly to the main body 120, the base section 15 further may include a bottom rim 135, which is preferably also an annular ring that projects away from the lower bottom end 125 of the base section 15 towards the lower base end 40. In alternative embodiments, the bottom rim 135 may be various shapes and sizes as known in the art.

The main body 120 also includes a central dispenser member 140; the central dispenser member 140 preferably is an integrally formed cylinder-shaped block that projects from the lower bottom end 125 of the base section 15 towards both the upper base end 35 and the lower base end 40. The central dispenser member 140 preferably extends to the same length or height as the bottom rim 135 or the upper rim 110 of the base section 15. Thus, the reservoir 130 is located and positioned within the main body 120, but outside of the central dispenser member 140.

Central dispenser member 140 further may include a base liquid lower channel 145 and a base liquid lower straw channel 150, wherein both channels 145 and 150 extend throughout the central dispenser member 140, from the lower bottom end 125 to the upper rim 110 of the base section 15.

Preferably, the base liquid lower straw channel 150 includes a base liquid straw 155 located within the channel 150. The base liquid straw 155 extends towards the upper base end 35. When the neck section 10 and the base section 15 are engaged, the base liquid straw 155 may extend into the secondary liquid straw aperture 80. The base liquid straw 155 also extends towards the opposite direction, into and past lower bottom end 125, and also extends past the bottom rim 135 and into the bottle containing the base liquid.

When the neck section 10 and the base section 15 of the pourer 5 are engaged, the base liquid lower channel 145 of the central dispenser member 140 and the base liquid upper channel 55 of the tapered tube 45 create a base liquid channel 150. The base liquid channel 150 further includes a base liquid rubber stopper channel 160, located and positioned within and extending through the rubber stopper 20. The rubber stopper 20 is located and positioned at the lower base end 40 of the base section 15, and extends over the central dispenser member 140, so that the rubber stopper 20 abuts lower bottom end 125 of the base section 15. The base liquid channel 150 is in communication with the base liquid when the pourer 5 is engaged with the bottle, and the base liquid may be dispensed from the bottle through the pourer 5, as will be explained below. In addition to the base liquid rubber stopper channel 160, the rubber stopper 20 also includes a base liquid aperture 165, wherein the base liquid straw 155 extends into and through the base liquid aperture 165.

Figure 4:
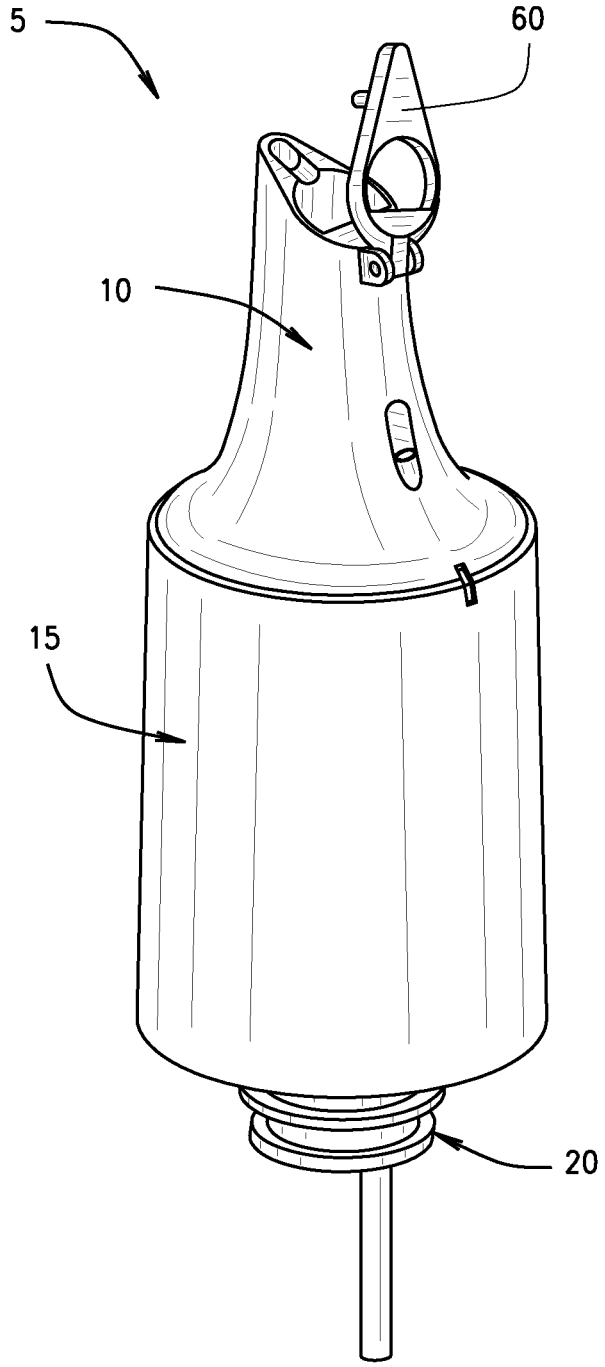
FIG. 4. is a perspective view of the pourer of FIGS. 1-3, with its lid in an open position.

In order to prepare pourer 5 for use, the rubber stopper 20 is inserted and extends into the neck of the bottle, until the lower bottom end 125 of the base section 15 abuts the lip of the bottle's opening. The bottom rim 135 of the base section 15 may extend past the opening and partway down the neck of the bottle (not illustrated). The bottom rim 135 preferably helps stabilize the pourer 5 when it is engaged with the bottle, by preventing the pourer 5 from being knocked off the bottle. The secondary liquid may be poured into the reservoir 130. The neck section 10 and base section 15 may then be engaged, as shown in FIGS. 1 and 4.

In order to dispense both the base liquid and the secondary liquid, the neck section 10 and the base section 15 of the pourer 5 should be engaged. The lid 60 of the pourer 5 should be raised, thereby placing the lid in an upwards or open position. Since the secondary liquid channel 50 is in communication with the secondary liquid within the reservoir 130, the secondary liquid may be dispensed from the reservoir 130 through secondary liquid channel 50 when the lid 60 is in its open position, as illustrated in FIG. 4. Likewise, the base liquid may also be dispensed from the bottle through the base liquid channel 150 because base liquid channel 150 is in communication with the base liquid within the bottle.

Alternatively, the user can choose only to dispense the base liquid. As illustrated in FIGS. 1 and 3, when the lid 60 is in its closed position, the plug 75 engages the secondary liquid channel 50, which prevents the secondary liquid, within reservoir 130, from being dispensed. However, even when the lid 60 is in its closed position, the base liquid may be dispensed from the bottle due to the lid aperture 70 in the lid 60. Therefore, the user is able to choose whether to dispense either the secondary and base liquids or just the base liquid by merely placing the lid 60 in an open or closed position, respectively. The user of the pourer 5 does not have to remove the pourer 5 from the bottle to dispense only the base liquid.

As illustrated in FIG. 3, when the neck section 10 and the base section 15 are engaged, the base liquid channel 150 is in communication with the base liquid within the bottle when the pourer 5 is engaged with the bottle. Therefore, the base liquid may be dispensed from the bottle through the pourer 5 when the lid 60 is in either an open or closed position. Similarly, when the neck section 10 and the base section 15 are engaged, the secondary liquid channel 50 is in communication with the secondary liquid within the reservoir 130. Thus, the secondary liquid may be dispensed from the reservoir 130, through the secondary liquid channel 50, if the lid 60 is in an open position. Therefore, the user may choose whether to dispense the secondary liquid by adjusting the position of the lid 60 from open to close, and vice versa, without removing the pourer 5 from the bottle.

When the base liquid is being dispensed, the base liquid straw 155 preferably equalizes the air pressure within the bottle. Air from outside of the pourer 5 preferably flows through the base liquid straw 155 into the bottle to equalize the air pressure between the interior and exterior of the bottle. The base liquid therefore may be dispensed at a substantially continuous rate. Similarly, when lid 60 is in an open position and both the secondary and base liquids are being poured, the secondary liquid straw 85 and base liquid straw 155 preferably equalize the air pressure within the bottle and reservoir 130 by allowing air into the reservoir 130 and bottle, respectively. Therefore, both the base liquid and secondary liquid will flow at a substantially continuous rate, helping to prevent the liquids from backing up and being dispensed in an unequal manner.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A pourer for selective engagement with a bottle, the pourer comprising:

a neck section, the neck section including:
- an upper neck end and a lower neck end;
- a secondary liquid channel extending from the upper neck end to the lower neck end of the neck section;
- a base liquid upper channel adjacent to the secondary liquid channel extending from the upper neck end to the lower neck end of the neck section;
- a lid pivotally attached to the upper neck end of the neck section including a lid aperture;

a base section, the base section including:
- a main body selectively engageable with the neck section at an upper base end and the bottle at a lower base end;
- a central dispenser member extending from the upper base end to the lower base end of the main body and including a base liquid lower channel in fluid communication with the bottle;

wherein when the lid is in an open position, a secondary liquid is able to be dispensed from the base section through the secondary liquid channel and a base liquid is able to be dispensed from the bottle through the base liquid lower channel and the base liquid upper channel; and wherein when the lid is in a closed position, only the base liquid is able to be dispensed through the base liquid lower channel and the base liquid upper channel.

2. The pourer of claim 1, wherein the neck section includes a secondary liquid straw aperture extending from the lower neck end through an interior of a tapered tube of the neck section, to a side of the tapered tube.

3. The pourer of claim 2, wherein a secondary liquid straw is located and positioned in the secondary liquid straw aperture for equalizing air pressure within the base section.

4. The pourer of claim 1, wherein the main body of the base section further includes a bottom rim extending past a lower bottom end of the main body for stabilizing the pourer when engaged with a bottle.

5. The pourer of claim 1, wherein the main body of the base section includes a base liquid lower straw channel, the base liquid lower straw channel extending from a lower bottom end to an upper rim and through the central dispenser member.

6. The pourer of claim 5, wherein a base liquid straw is located and positioned within the base liquid lower straw channel for equalizing air pressure within the bottle.

7. The pourer of claim 1, wherein the lid includes a plug that is selectively engageable with the secondary liquid channel.

8. The pourer of claim 1, wherein the pourer includes an O-ring located and positioned between the neck section and the base section when the neck section and base section are engaged.

9. The pourer of claim 1, wherein the neck section and base section selectively engage with one another through a threaded mechanism.

10. The pourer of claim 1, wherein the neck section and the base section selectively engage with one another through a friction fit mechanism.

11. A pourer for selective engagement with a bottle, the pourer comprising:

a neck section, the neck section including:

an upper neck end and a lower neck end;

a secondary liquid channel extending from the upper neck end to the lower neck end of the neck section;

a base liquid upper channel adjacent to the secondary liquid channel, extending from the upper neck end to the lower neck end of the neck section;

a lid pivotally attached to the upper neck end of the neck section including a lid aperture;

a base section, the base section including:

a main body selectively engageable with the neck section at an upper base end and the bottle at a lower base end;

a central dispenser member extending from the upper base end to the lower base end of the main body and including a base liquid lower channel in fluid communication with the bottle;

wherein the lid can be in a first position or a second position;

wherein the lid is in its first position, both the secondary liquid and the base liquid can be dispensed;

wherein the lid is in its second position, only the base liquid can be dispensed.

12. The pourer of claim 11, wherein the neck section includes a secondary liquid straw aperture extending from the lower neck end through an interior of a tapered tube of the neck section, to a side of the tapered tube.

13. The pourer of claim 12, wherein a secondary liquid straw is located and positioned in the secondary liquid straw aperture for equalizing air pressure within the base section.

14. The pourer of claim 11, wherein the main body of the base section further includes a bottom rim extending past a lower bottom end of the main body for stabilizing the pourer when engaged with a bottle.

15. The pourer of claim 11, wherein the main body of the base section includes a base liquid lower straw channel, the base liquid lower straw channel extending from a lower bottom end to an upper rim and through the central dispenser member.

16. The pourer of claim 15, wherein a base liquid straw is located and positioned within the base liquid lower straw channel for equalizing air pressure within the bottle.

17. The pourer of claim 11, wherein the lid includes a plug, that is selectively engageable with the secondary liquid channel.

18. The pourer of claim 11, wherein the pourer includes an O-ring located and positioned between the neck section and the base section when the neck section and base section are engaged.

19. The pourer of claim 11, wherein the neck section and base section selectively engage with one another through a threaded mechanism.

20. The pourer of claim 11, wherein the base section includes a reservoir for containing the secondary liquid.

* * * * *